United States Patent [19]

Gomi

[11] 4,293,235

[45] Oct. 6, 1981

[54] STRUCTURE FOR A LINEAR MOTOR FOR A PRINTER

[75] Inventor: Yoshifumi Gomi, Shiojiri, Japan

[73] Assignee: Kabushiki Kaisha Suwa Seikosha, Tokyo, Japan

[21] Appl. No.: 31,690

[22] Filed: Apr. 19, 1979

[30] Foreign Application Priority Data

Apr. 19, 1978 [JP] Japan ..... 53-46195
Apr. 19, 1978 [JP] Japan ..... 53-46196

[51] Int. Cl.[3] ..... B41J 19/50
[52] U.S. Cl. ..... 400/322; 400/320; 400/352; 400/903
[58] Field of Search ..... 310/13, 14, 15; 400/320, 322, 323, 328, 352, 353

[56] References Cited

U.S. PATENT DOCUMENTS 4,044,881 8/1977 Chai et al. ..... 400/903 X
4,149,808 4/1979 Matthias et al. ..... 400/322 X

*Primary Examiner*—Paul T. Sewell
*Attorney, Agent, or Firm*—Blum, Kaplan, Friedman, Silberman & Beran

[57] ABSTRACT

A linear motor for a printer has stator teeth which are protected from dust and debris generated when the printing mechanism strikes the recording paper by a downward extension of the stator teeth, by a horizontal extension of the stator teeth, or by a horizontal extension of stator teeth which face away from the printing platen. The translating member of the motor to which the printing mechanism is attached has pole teeth spaced from the stator by mechanical rollers. The motor force acts close to the center of gravity of the moving members to reduce mechanical vibrations.

4 Claims, 8 Drawing Figures

201
204
205
205
202a
F
G2
203
202
8
8
208
f
211
210
209

201
205
204
207
205
203
g
220
202
202a
208
206
f
210
210
209

STRUCTURE FOR A LINEAR MOTOR FOR A PRINTER

BACKGROUND OF THE INVENTION

This invention relates generally to a linear motor of the type used in mechanical printers and more particularly to a linear printer motor wherein the stator teeth are protected from dust and the motor force acts close to the center of gravity of the moving elements. The accumulation of dust from printing on the stator teeth of the linear motor has been a problem in prior art linear motors. The dust and other materials such as metalic particles which drop on the stator when the printer is used, are caught in the stator teeth causing deteriorated operation of the linear pulse motor. In order to minimize such defects in performance, it has been considered to level the surface of the stator by filling up the stator teeth with synthetic resin or the like. Alternatively, a dust shield may be attached to the stator, or the entire motor covered with a dust cover. However, in applying such protective devices, the linear pulse motor becomes more expensive to manufacture.

What is needed is a linear motor for a printer wherein the stator teeth are protected from the accumulation of dust without the use of special costly protective elements. It is also desirable that there be low vibration induced in the moving parts when the motor or the printing mechanism is actuated.

SUMMARY OF THE INVENTION

Generally speaking, in accordance with the invention, a linear motor especially suitable for a printer is provided. The linear motor has stator teeth which are protected from dust and debris produced when the printing mechanism strikes the recording paper. This protection is accomplished by a downward extension of the stator teeth, by a horizontal extension of the stator teeth, of by a horizontal extension of stator teeth which face away from the printing platen. Special protective devices are not required. The translating member of the motor to which the printing mechanism is attached has pole teeth spaced form the stator by mechanical rollers. The motor force acts close to the center of gravity of the moving members to reduce mechanical vibrations.

Accordingly, it is an object of this invention to provide an improved linear motor for a printer which is protected from the accumulation of dust and debris on the stator teeth.

Another object of this invention is to provide an improved linear motor for a printer wherein the motor force acts close to the center of gravity of the moving elements.

A further object of this invention is to provide an improved linear motor for a printer wherein the impact force of printing acts perpendicular to the stator teeth.

Still other objects and advantages of the invention will, in part be obvious and will in part be apparent from the specification.

The invention accordingly comprises the features of construction, combination of elements, an arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
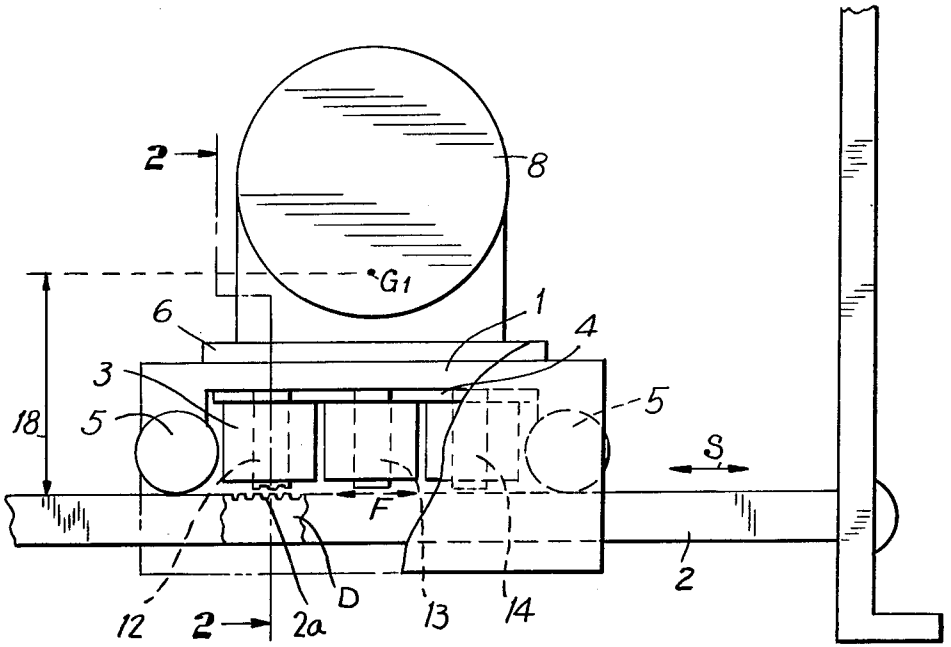
FIG. 1 PRIOR ART
FIG. 1 is an elevational view of a linear motor connected to a printing mechanism of the prior art.
Figure 2:
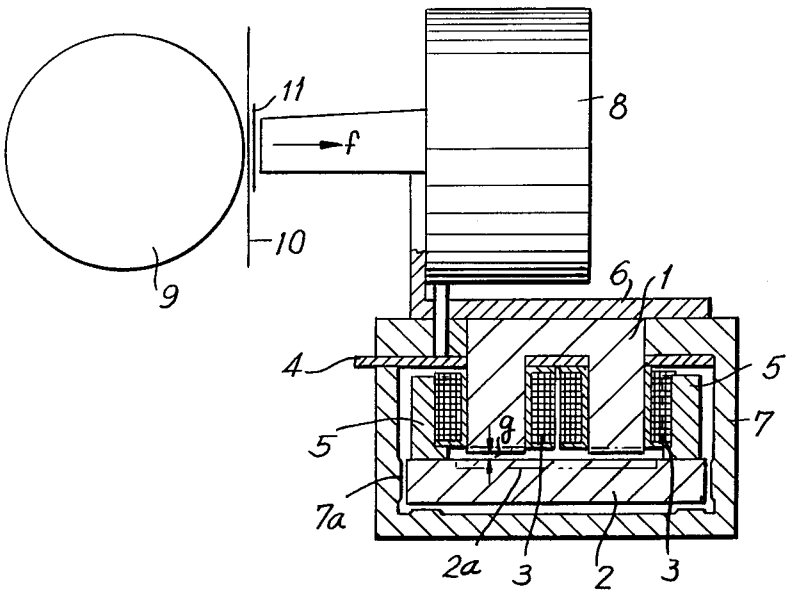
FIG. 2 PRIOR ART
FIG. 2 is a sectional view taken along the line 2—2 of FIG. 1.

With reference to FIGS. 1 and 2, a detailed description of a printer using a conventional three phase linear pulse motor of the prior art is presented hereinafter. A translating member 1 of the linear motor, which corresponds to the rotor of a conventional motor, is formed of magnetic material in which respective poles 12, 13, 14, having cross-sectional shapes as shown in FIG. 2, are arranged with predetermined separations therebetween. The poles 12, 13, 14 include pole teeth. Each pole, which is inserted into a driving coil 3, is fixed on a wiring base plate 4. A stator 2, has stator teeth 2*a* opposing the pole teeth of the translating member 1 respectively as shown at the partial section D (FIG. 1). Rotation of rollers 5 is permitted by ball bearings (not shown) and the rollers are supported in the conventional manner, not shown to simplify the drawings and explanation herein, to maintain a constant gap g between the respective pole teeth of the translating member 1 and the stator 2. A printing mechanism portion 8 is mounted on the mounting board 6, and a guide 7 aligns the translating member 1 to the stator 2. A recording paper 10 and a ribbon 11 are positioned between the platen 9 and printing mechanism 8 for printing on paper 10. The dynamic characteristics of the linear pulse motor are not different from that of a rotary pulse motor, and the linear pulse motor moves ahead and back in the direction indicated by the arrow S by switching the electrical signal from one pole to another pole in the conventional manner.

The structure of a conventional linear pulse motor as shown in FIGS. 1 and 2 has the following deficiencies. Because dust from the recording paper 10 covers the stator 2 while printing is effected by the printing mechanism 8 over an extended period of time, normal operation of the linear pulse motor over long periods cannot be expected. Ultimately, the linear pulse motor operates poorly. Especially when using a conventional linear pulse motor for an impact printer, the linear pulse motor is greatly affected by dust since paper dust is raised due to impact of the printing mechanism 8 against the recording paper 10 at the time of printing. Also, metalic particles, which drop on the stator 2 when using the printer, are caught in the stator teeth 2a causing deteriorated operation of the linear pulse motor. In order to resolve such defects in performance, it has been considered to level the surface of the stator 2 by filling-up the stator teeth 2a with synthetic resin or the like, or a dust shield has been attached to the stator 2, or the entire motor is covered with a dust cover. However, in applying such devices, the linear pulse motor becomes expensive to manufacture.

The center of gravity of the moving mechanism which includes the translating member 1 and the printing mechanism 8, is located at the position $G_1$ in FIG. 1. Because the driving force F of the linear pulse motor is generated in the stator 2 and respective pole teeth of the translating member 1, there is a large distance 18 between the center of gravity $G_1$ of the moving members and the portion of the linear pulse motor where the driving force F acts. This moment causes vibration in the translating member 1 and in all moving elements associated with the translating member 1. Further, in an impact type dot printer, the printer mechanism 8 receives the reaction force F at the time of printing at a much higher position above the surface near the tooth level where the linear motor is driven. This also causes vibration. A stator guide 7a on the guide 7 receives a part of the reaction force on each printing impact and accordingly the stator guide 7a is apt to be worn out in a relatively short period of time.

The linear motor of this invention eliminates all the defects mentioned above, and reduces the cost of manufacture. An embodiment of this invention is given with reference to FIG. 3 and to FIG. 4 which shows a section taken along the line 4—4 of FIG. 3. Because the embodiment shown in FIGS. 3 and 4 has elements similar to the printer shown in FIGS. 1 and 2, the reference numerals in FIGS. 3 and 4 of the similar elements are selected by adding 20 to each corresponding reference numeral in FIGS. 1 and 2. Therefore, the following description of the individual elements is abbreviated.

Figure 3:
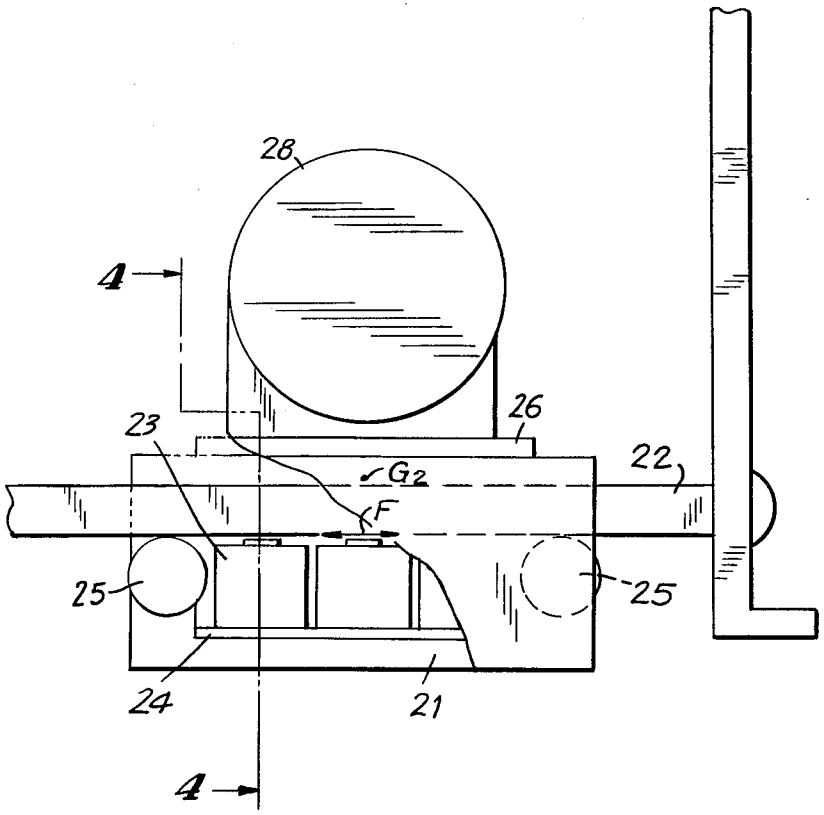
FIG. 3 is an elevational view of a linear motor and printer in accordance with a first embodiment of this invention.
Figure 4:
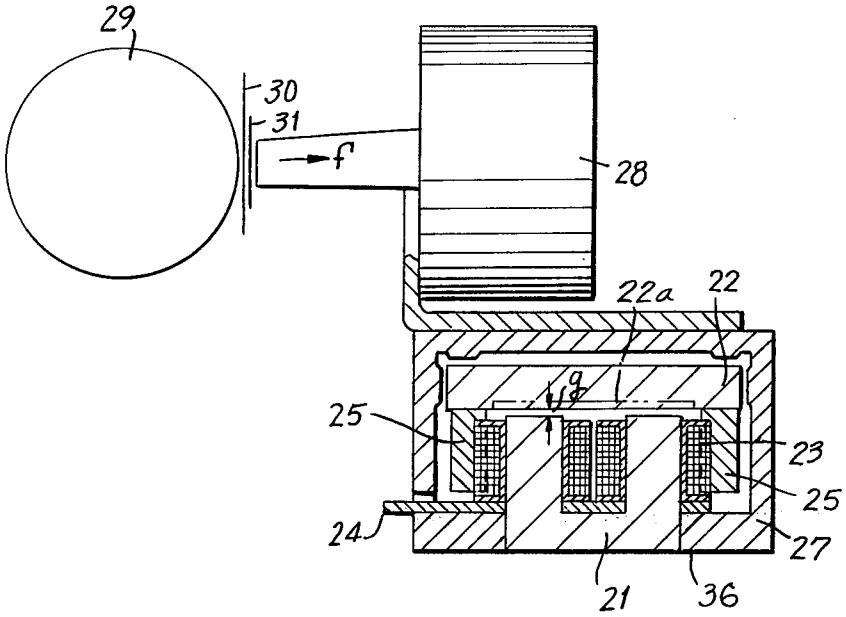
FIG. 4 is a cross-sectional view taken along the line 4—4 of FIG. 3.

A major difference between the embodiment in FIGS. 3 and 4 and the printer in FIGS. 1 and 2 is that the stator teeth portion 22a of the stator 22 faces downwardly with the teeth extending toward the bottom 36 of the printer and the stator 22 is located above the translating element 21. Particularly the translating element 21 is positioned under the stator 22, and the printing mechanism 28 is mounted to the moving translating member 21 in such a way that the stator 22 is held between the printing mechanism 28 and the translating member 21. Because of the structure in the linear motor of this invention, dust from the recording paper does not fall upon and attach to the teeth of the stator and the translating member 21. This cause of inferior operation of the linear pulse motor is removed without using any complicated structures as discussed above.

As seen in FIG. 4, the guide 7 is basically a rectangle frame enclosing a portion of the stator 22 for alignment thereto, and supporting both the printing mechanism 28 and the translating member 21. The guide 7, printing mechanism 28 and translating mechanism 21 move as a unit in the known manner in the directions S relative to the stator 22 on the rollers 25 when the coils 23 are electrically energized to induce magnetic fields in the poles. The location of the center of gravity $G_2$ is a resultant effect of the relative masses and centers of gravity of the three moving elements 21, 27, 28 and excludes the stator mass. The mass of the coils 23 is associated with and moves with the translating member 21 and also affects the center of gravity $G_2$. Accordingly, when the position of the translating member 21 is moved relative to the guide 27 and printing mechanism 28, the location of the center of gravity $G_2$ moves in the same direction as does the translating member 21 with the coils 23.

Because the stator 22 is arranged (FIGS. 3, 4) in a manner such that the translating member 21 and printing mechanism 28 holds the stator 22 between them, with the translating member 21 at the lower position, the center of gravity $G_2$ of the moving portion including the guide 27, translating member 21 and the printing mechanism 28 is moved, when compared to $G_1$ in FIG. 1, extremely close to the position where the driving force F of the linear pulse motor acts. This results in a diminution of causes for vibration when the rotor and print mechanism operate. Thus, this linear motor has many advantages when used with a printer and is highly effective in eliminating dust and vibration problems.

Figure 5:
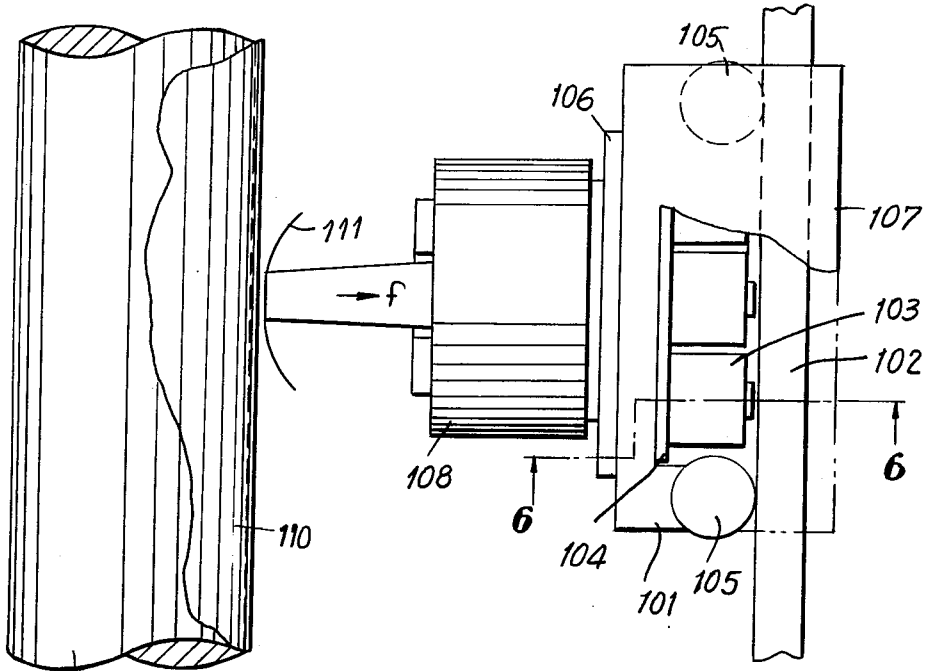
FIG. 5 is a plan view of an alternative embodiment of the linear motor and printer of this invention.
Figure 6:
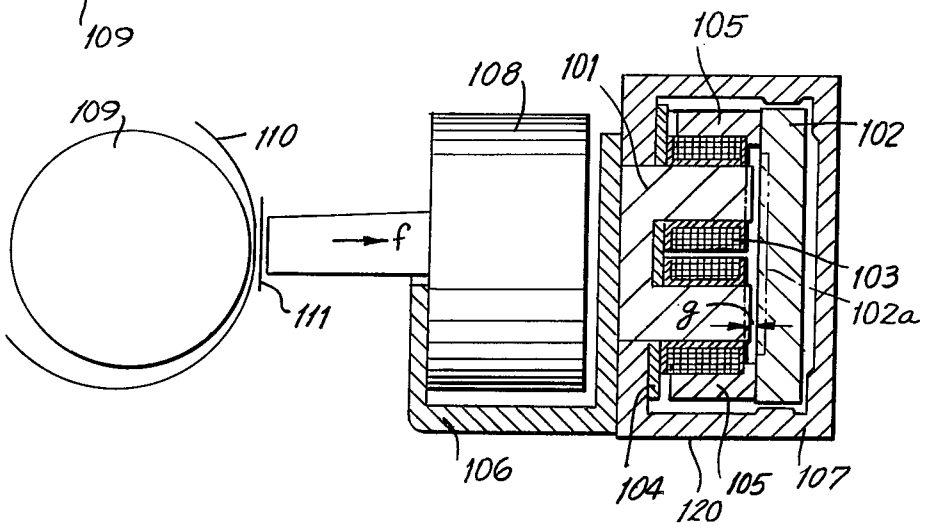
FIG. 6 is a sectional view taken along the line 6—6 of FIG. 5.

FIGS. 5 and 6 show an alternative embodiment of a linear motor for a printer of this invention. Because the alternative embodiment shown in FIGS. 5 and 6 has elements similar to the printer shown in FIGS. 1 and 2, the reference numerals in FIGS. 5 and 6 for the similar elements are selected by adding 100 to each corresponding reference numeral in FIGS. 1 and 2. Therefore, the description of the individual elements is abbreviated.

A difference between the embodiment in FIGS. 5 and 6 and the printer in the FIGS. 1 and 2 is that the teeth portion 102a of the stator 102 is perpendicular to the bottom 120 of the printer and the teeth extend horizontally from the stator. Another difference resides in the fact that the stator 102 receives the reaction force f, which the printing mechanism 108 imparts when printing, in the direction perpendicular to the surface of the teeth portion 102a of the stator 102 through the rollers 105 which include ball bearings. The rollers 105 maintain a constant gap g between the stator 102 and the translating member 101. With such a structure, even if paper dust or the like is scattered toward the surface of the teeth portion 102a of the stator 102, the paper dust, or similar materials, including metal chips, falls down to the bottom of the printer through the agency of gravity. The paper dust which has a bad effect on the operation of the translating member 101 does not attach to the surface of the teeth portion 102a of the stator 102. Additionally, since the stator 102 receives the reaction force f of printing from the printing mechanism 108 in a direction perpendicular to the stator 102 through the rollers 105, the causes for vibration and wear are removed. The rollers 105 include ball bearings having a low coefficient of friction and high rigidity. The ball bearings are not shown in the drawings.

Figure 7:
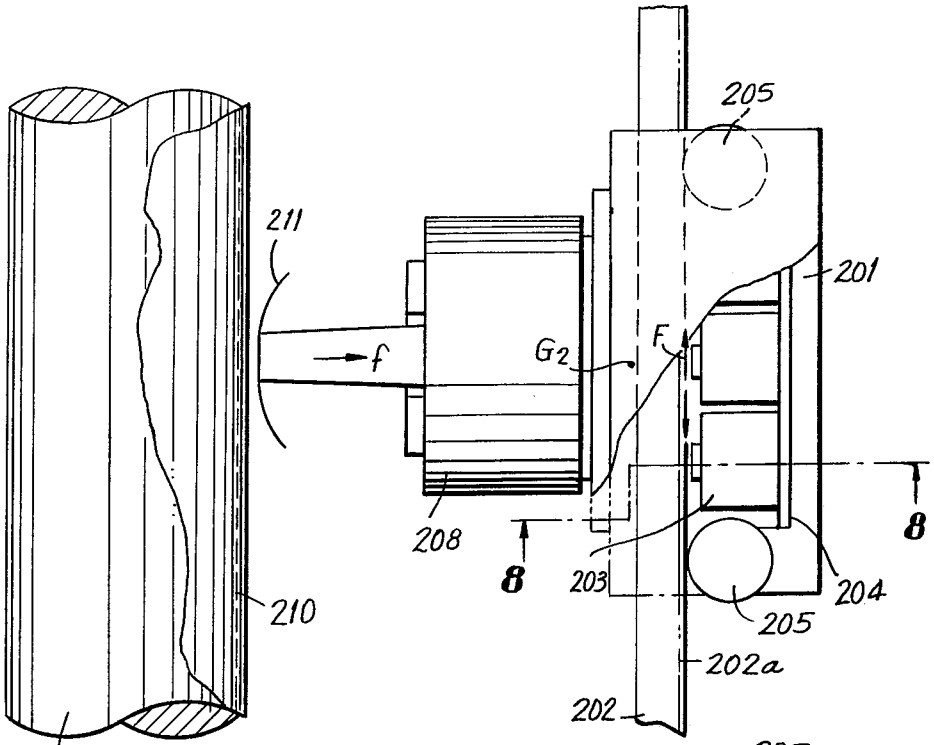
FIG. 7 is a plan view of another alternative embodiment of the linear motor and printer of this invention.
Figure 8:
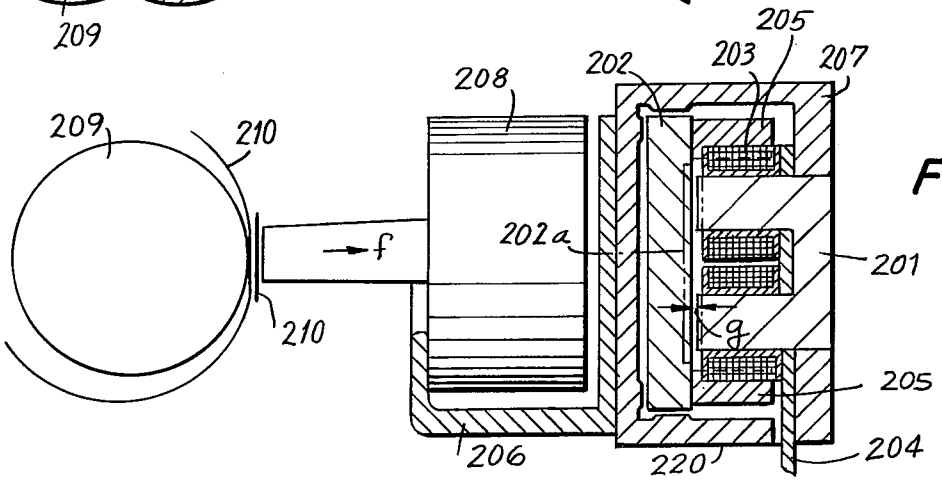
FIG. 8 is a sectional view taken along the line 8—8 of FIG. 7.

Another alternative embodiment of the linear motor of this invention is shown in FIGS. 7 and 8. Because the embodiment shown in FIGS. 7 and 8 has elements similar to the printer shown in FIGS. 1 and 2, the reference numerals in FIGS. 7 and 8 for the similar elements are selected by adding 200 to each corresponding reference numeral in FIGS. 1 and 2.

This structure is used to locate the center of gravity $G_2$ of the portion including the translating member 201 and the printing mechanism portion 208 close to the surface where the linear motor is driven. FIG. 7 is a top plan view and FIG. 8 is a cross-sectional view taken along line 8—8 of FIG. 7. In addition to the difference, namely, that the surface of the teeth portion 202a of the stator 202 is perpendicular to the bottom 220 of the printer, another difference between the embodiment in FIGS. 7 and 8 and the printer in FIGS. 1 and 2 is that the surface of the teeth portion 202*a* of the stator 202 faces in the direction opposite from the platen 209 with the teeth extending horizontally from the stator. In the printers of FIGS. 1 through 4, the stator teeth face the platen.

Another difference is that the stator 202 is held between the translating member 201 and the printing mechanism 208. In such a structure, the paper dust does not attach to the surface of the teeth portion 202*a* of the stator 202 because the surface of the teeth portion 202*a* is facing away from the parts where the paper dust is generated and raised. Thus, deteriorated operation of the linear motor due to paper dust does not occur. Further, since the stator 202 is held between the translating member 201 and printing mechanism portion 208, the center of gravity $G_2$ of the moving portion including the translating member 201 and the printing mechanism portion 208 is located extremely close to the position where the driving force F of the linear motor acts. This results in a diminuation of causes for vibration. Thus, this invention is highly advantageous and effective.

In the description related to FIGS. 5 through 8, the surface of the teeth portion of the stator has been described as being perpendicular to the bottom of the printer. However, alternative embodiments of this invention, wherein the teeth surface is not precisely perpendicular to the bottom, also have the same effectiveness in reducing vibration and protecting the stator teeth surfaces from an accumulation of dust.

It will thus be seen that the objects set forth above, among those made apparent from the preceding description, are effeciently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A linear pulse motor for a printer comprising:

a linear stator having stator teeth on a surface thereof, said surface being perpendicular to the bottom of said printer, said stator teeth extending horizontally from said stator surface;

a translating member including a plurality of poles, said poles being spaced apart and inserted into electrical coils, each of said poles having pole teeth in a surface thereof, said pole teeth opposing said stator teeth;

a printing mechanism mounted to said translating member and moving side to side in a horizontal direction the horizontal centers of said translating member and said printing mechanism being substantially aligned with the horizontal center line of said linear stator, whereby the force of printing acts perpendicularly on said stator surface having said stator teeth thereon;

mean for aligning and spacing whereby a gap is maintained between said stator teeth and said pole teeth, and said translating member moves linearly relative to said stator when said pole coils are electrically energized, whereby motor and printing vibrations are reduced and dust and debris do not fall upon said stator teeth.

2. A linear pulse motor for a printer of claim 1 wherein said translating member is positioned between said stator and said printing mechanism.

3. The linear pulse motor for a printer of claim 1, wherein said stator is positioned between said translating member and said printing mechanism.

4. The linear pulse motor for a printer of claim 3, wherein said stator teeth face away from said printing mechanism, whereby said dust from printing does not fall on said stator teeth and said motor force acts close to the center of gravity of said combined moving parts including said translating member and said printing mechanism.

* * * * *

UNITED STATES PATENT AND TRADEMARK OFFICE

CERTIFICATE OF CORRECTION

PATENT NO. : 4,293,235

DATED : October 6, 1981

INVENTOR(S) : YOSHIFUMI GOMI

It is certified that error appears in the above—identified patent and that said Letters Patent is hereby corrected as shown below:

On the title page, please insert

-- [73] Assignee: Kabushiki Kaisha Suwa Seikosha, Tokyo, Japan and Shinshu Seiki Kabushiki Kaisha, Nagano-ken, Japan --

Signed and Sealed this

*Twenty-seventh* Day of *April 1982*

[SEAL]

*Attest:*

GERALD J. MOSSINGHOFF

*Attesting Officer*

*Commissioner of Patents and Trademarks*